US011796144B2

(12) United States Patent
McCane et al.

(10) Patent No.: US 11,796,144 B2
(45) Date of Patent: Oct. 24, 2023

(54) SYSTEMS AND METHODS FOR MOUNTING RECESSED LIGHT FIXTURES

(71) Applicant: ABL IP Holding LLC, Atlanta, GA (US)

(72) Inventors: Stephen Barry McCane, McDonough, GA (US); Dallin Andrew Parker, Fayetteville, GA (US); Matthew Thomas Emerick, Decatur, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 17/740,548

(22) Filed: May 10, 2022

(65) Prior Publication Data

US 2022/0364694 A1 Nov. 17, 2022

Related U.S. Application Data

(60) Provisional application No. 63/188,062, filed on May 13, 2021.

(51) Int. Cl.

| | |
|---|---|
| ***F21S 8/02*** | (2006.01) |
| ***F21V 21/14*** | (2006.01) |
| ***F21V 21/04*** | (2006.01) |

(52) U.S. Cl.
CPC ..... *F21S 8/026* (2013.01); *F21V 21/04* (2013.01); *F21V 21/14* (2013.01)

(58) Field of Classification Search
None
See application file for complete search history.

(56) References Cited

U.S. PATENT DOCUMENTS

| | | | | |
|---|---|---|---|---|
| 9,803,838 | B1 * | 10/2017 | Wronski | F21S 8/02 |
| 11,402,081 | B1 * | 8/2022 | Hargroder | F21V 29/70 |
| 2015/0085476 | A1 * | 3/2015 | Mandy | F21V 29/773 362/147 |

* cited by examiner

*Primary Examiner* — Elmito Breval
(74) *Attorney, Agent, or Firm* — Kilpatrick Townsend & Stockton LLP

(57) ABSTRACT

A mounting system for a recessed light fixture includes a frame and a holder supported by the frame. The holder includes a base and a support portion extending from the base. The support portion includes a top end, a bottom end opposite from the top end, and an edge extending from the top end to the bottom end. The edge includes a transition portion between the top end and the bottom end, a first step between the bottom end and the transition portion, and a plurality of second steps between the first step and the transition portion. At least one characteristic of the first step is different from each second step.

20 Claims, 15 Drawing Sheets

SYSTEMS AND METHODS FOR MOUNTING RECESSED LIGHT FIXTURES

REFERENCE TO RELATED APPLICATION

This application claims the benefit of U.S. Provisional Application No. 63/188,062, filed on May 13, 2021, and entitled SYSTEMS AND METHODS FOR MOUNTING RECESSED LIGHT FIXTURES, the content of which is hereby incorporated by reference in its entirety.

FIELD OF THE INVENTION

This application relates recessed light fixture, and, more particularly, to systems and methods for mounting recessed light fixtures.

BACKGROUND

In certain environments, including but not limited to healthcare lighting, it may be desirable to include light fixtures that are recessed into a surface (e.g., a ceiling). Such recessed light fixtures are typically mounted from below the surface and require attachment to a building structure above the light fixture for support. These installations needing attachment to the building structure above may be difficult and time-consuming to implement.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments, a mounting system for a recessed light fixture includes a frame and a holder supported by the frame. The holder includes a base and a support portion extending from the base. The support portion includes a top end, a bottom end opposite from the top end, and an edge extending from the top end to the bottom end. The edge includes a transition portion between the top end and the bottom end. In some embodiments, a distance from the transition portion to the base a minimum distance between the edge and the base. The edge also includes a first step between the bottom end and the transition portion and a plurality of second steps between the first step and the transition portion. In certain embodiments, at least one characteristic of the first step is different from each second step.

According to various embodiments, a holder for a mounting system for a recessed light fixture includes a base and a support portion extending from the base. The support portion includes a plurality of first steps and a plurality of second steps opposite from the base. In some embodiments, a height of each first step is different from a height of each second step.

According to some embodiments, a light fixture system includes a mounting system, and the mounting system includes an engagement component and a holder. The engagement component includes an end and is compressible. The holder includes a base and a support portion extending from the base. The support portion includes an edge opposite from the base, and the edge includes a first step and a second step opposite from the base. In some embodiments, a height of the first step is different from a height of the second step. In various embodiments, the end of the engagement component may selectively engage at least one of the first step or the second step.

According to certain embodiments, a method of mounting a recessed light fixture with a mounting system includes inserting the mounting system through an aperture in a ceiling and securing a frame of the mounting system to an upper surface of the ceiling. The method includes inserting a light fixture into the aperture in the ceiling and vertically moving the light fixture to a first position such that an engagement component on the light fixture is compressed and the engagement component engages a first step of a holder of the mounting system. The method may include moving the light fixture vertically to a second position such that the engagement component disengages the first step and engages a second step of the holder of the mounting system, where a height of the first step is greater than a height of the second step.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
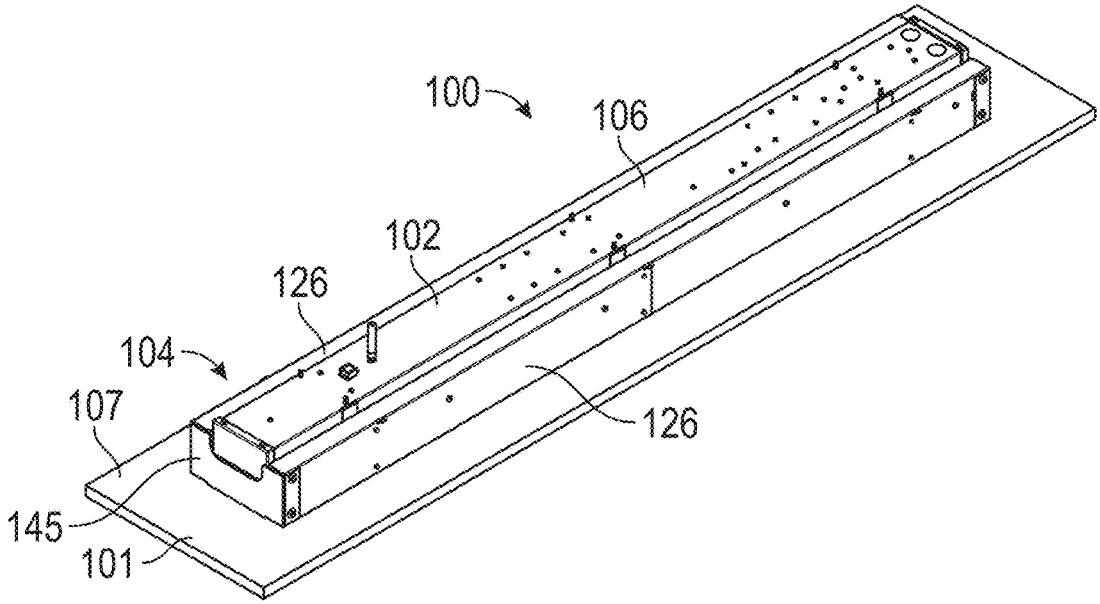
FIG. 1 is a top perspective view of a recessed light fixture with a mounting system installed in a surface according to embodiments.
Figure 2:
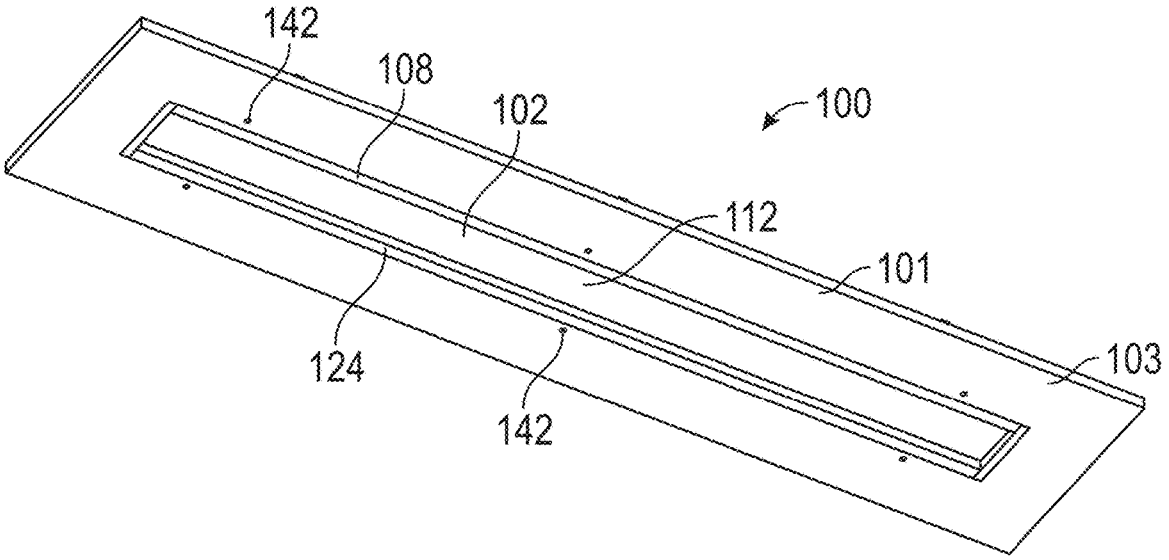
FIG. 2 is a bottom perspective view of the light fixture of FIG. 1.
Figure 3:
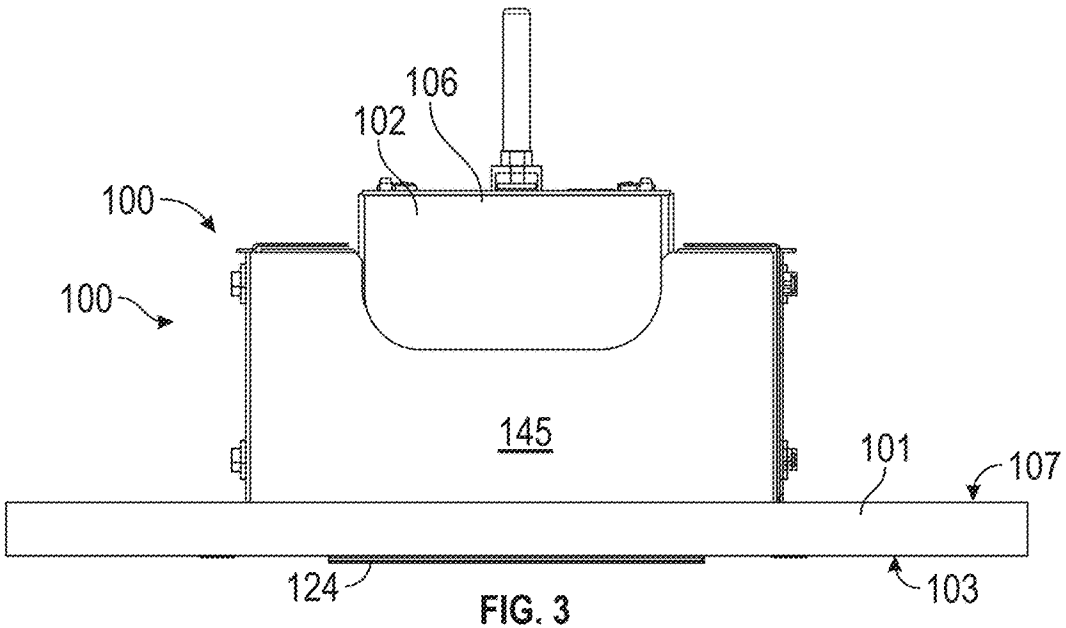
FIG. 3 is an end view of the light fixture of FIG. 1.

Described herein are light fixtures, including but not limited to recessed fixtures, and mounting systems for such fixtures. While the embodiments disclosed herein are not limited to a particular fixture, such features may be particularly suitable for linear fixtures (e.g., having a fixture length that is greater than a fixture width). The mounting systems described herein may generally include an engagement component that is connected or otherwise attached to the light fixture, one or more frames, and one or more holders that are supported by the one or more frames. In certain embodiments, a single frame may include a plurality of holders, although it need not in other embodiments. The frames may support the holders adjacent to an opening that is defined in a ceiling or other location as desired. While reference is made herein to the light fixture systems being mounted in/on a ceiling, they are by no means limited, and may be mounted or otherwise supported on other surfaces or structures as desired. Each holder includes a first stepped portion and a second stepped portion. The engagement component on the light fixture may engage the first stepped portion or the second stepped portion to support the light fixture relative as it is pushed through the opening and secure the light fixture to the ceiling (or other structure). As such, the light fixtures and mounting systems described herein may allow for installation of the light fixture from below a surface (e.g., a ceiling) without requiring attachment to a building structure above the light fixture.

FIGS. 1-19 illustrate an example of a light fixture system 100 that includes a light fixture 102 and a mounting system 104 according to various embodiments.

The light fixture 102 of FIGS. 1-19 is a linear light fixture, although it need not be in other embodiments. The light fixture 102 may include a housing 106, a mounting substrate 108, a reflector 110, a lens or optic 112, one or more light sources 114 (see FIGS. 22 and 27), electronics 116 such as drivers and/or power sources (see FIG. 27), various subcombinations thereof, and/or other components and/or features as desired.

Figure 7:
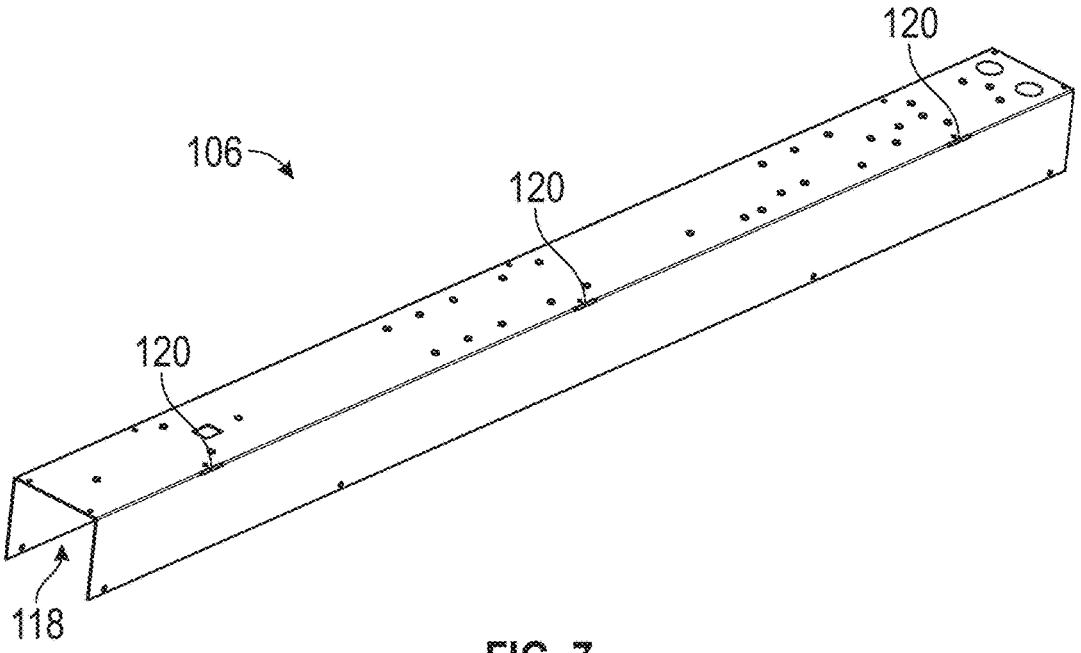
FIG. 7 is a perspective view of a housing of the light fixture of FIG. 1.
Figure 9:
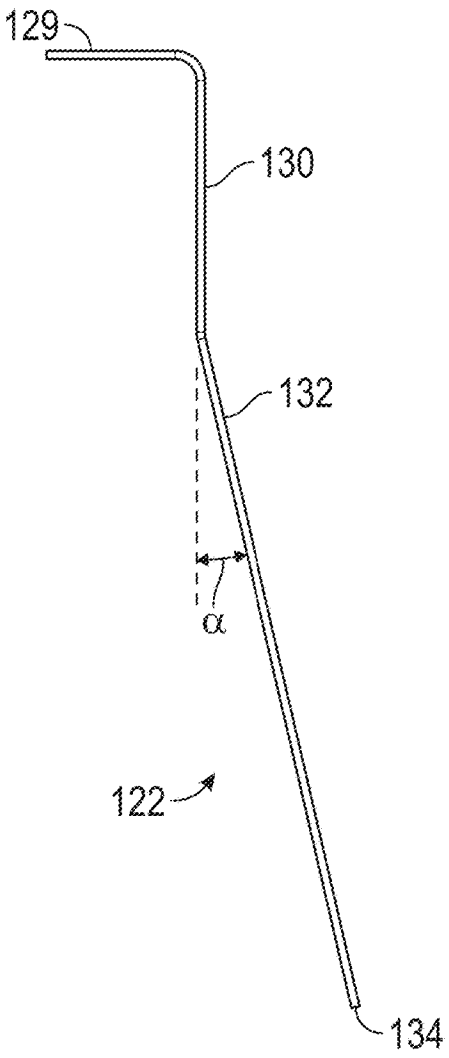
FIG. 9 is a side view of the engagement component of FIG. 8.
Figure 8:
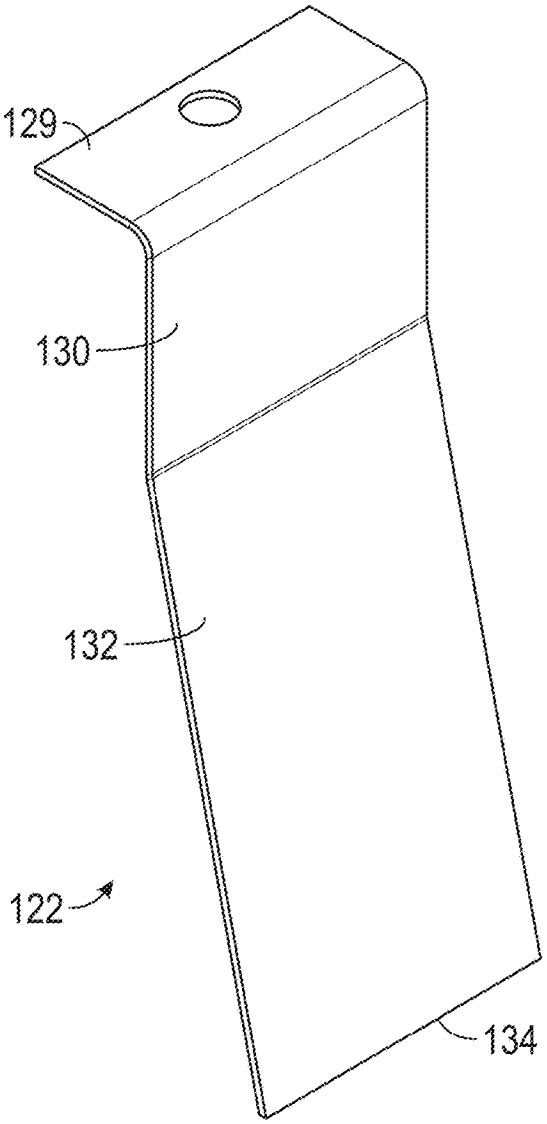
FIG. 8 is a perspective view of an engagement component of the light fixture of FIG. 1.
Figure 22:
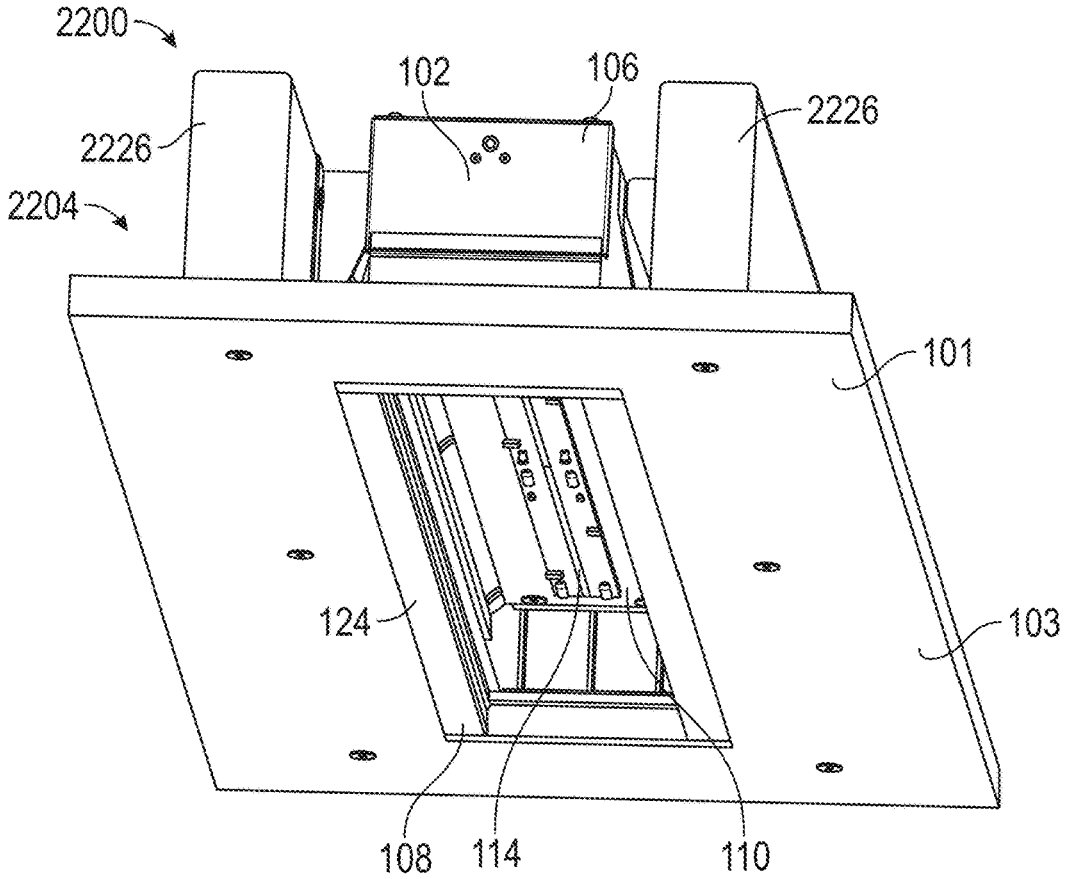
FIG. 22 is a bottom perspective view of a recessed light fixture with a mounting system installed in a surface according to embodiments.
Figure 23:
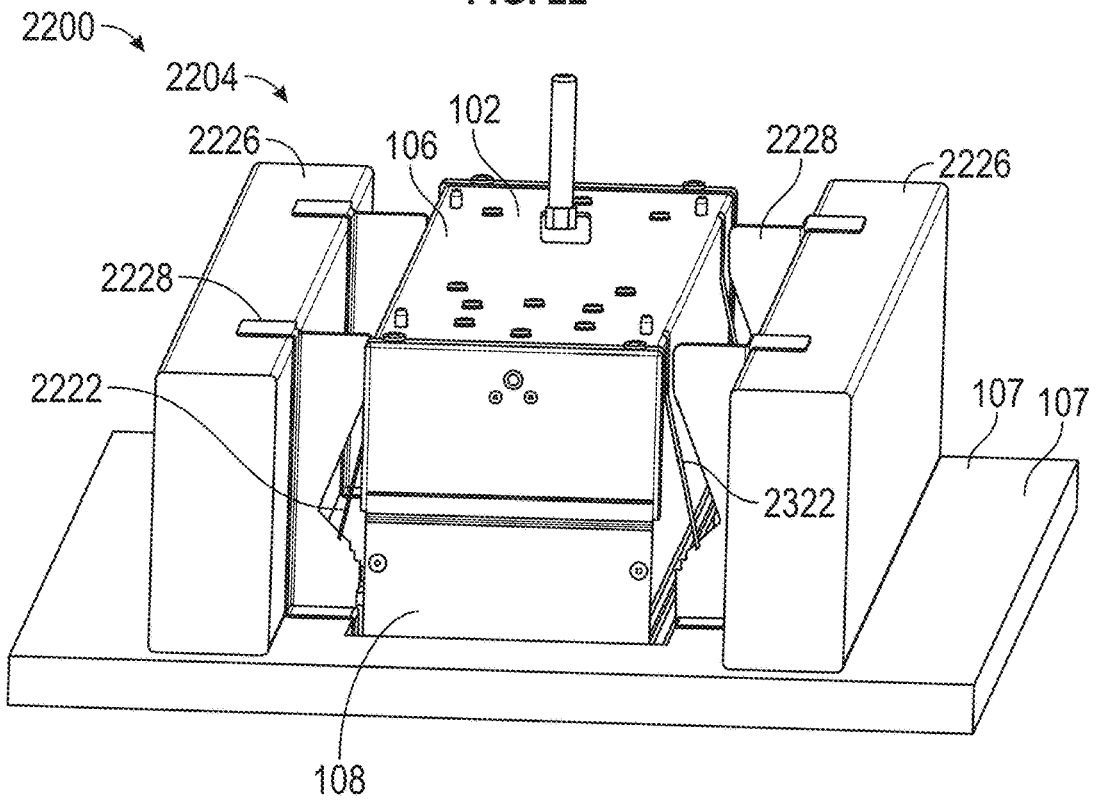
FIG. 23 is a top perspective view of the light fixture of FIG. 22.
Figure 26:
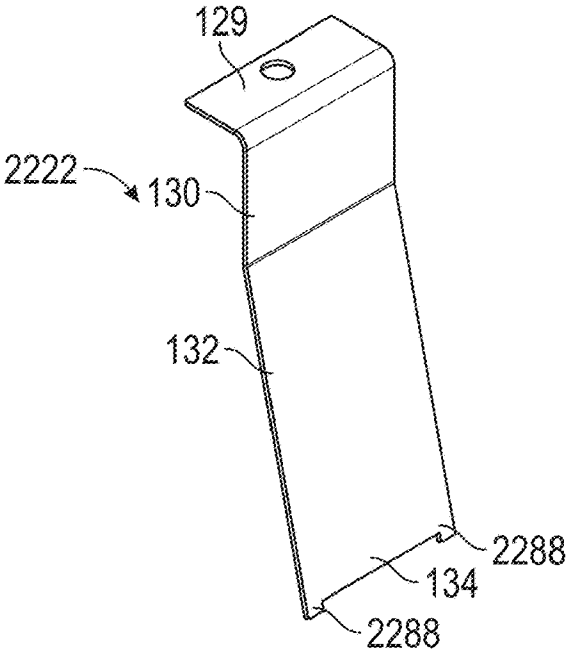
FIG. 26 is a perspective view of an engagement component of the light fixture of FIG. 22.
Figure 25:
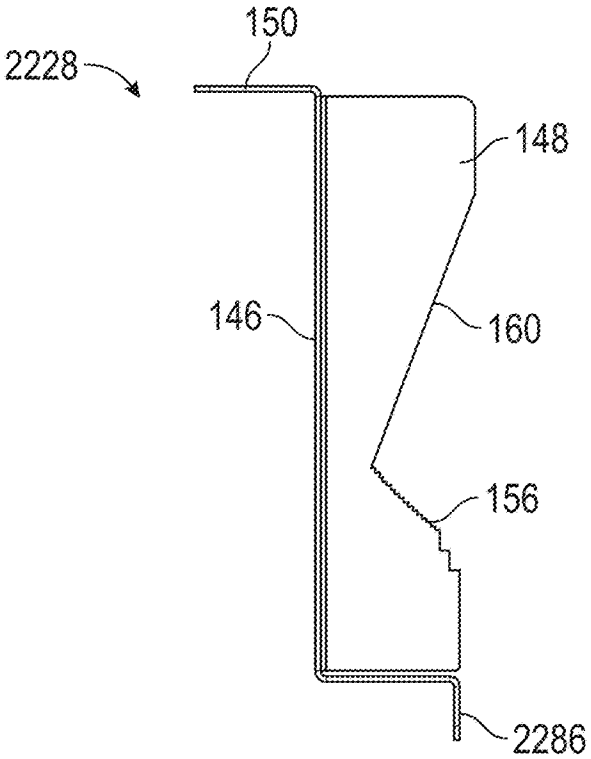
FIG. 25 is an end view of the holder of FIG. 24.
Figure 24:
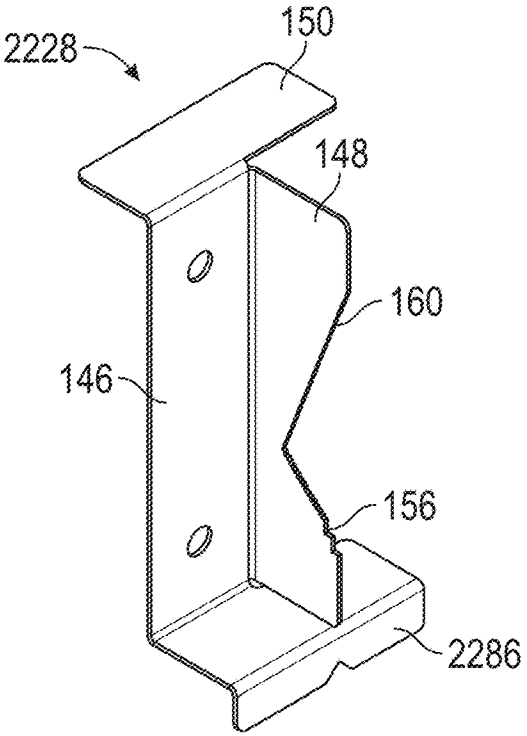
FIG. 24 is a perspective view of a holder of the mounting system of FIG. 22.
Figure 27:
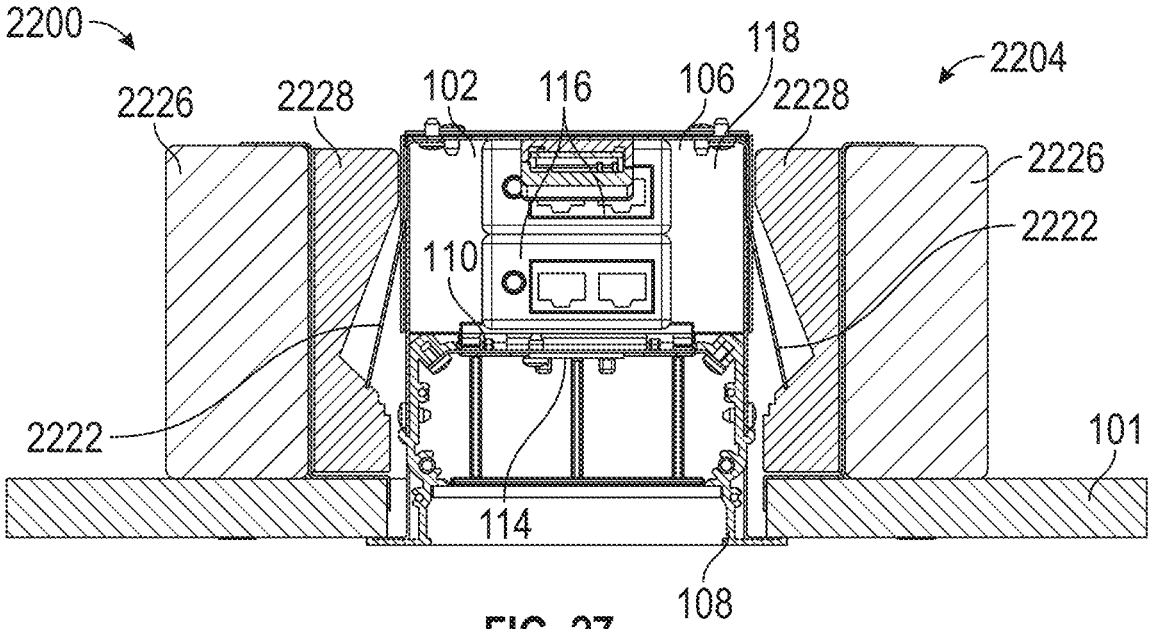
FIG. 27 is a sectional view of the light fixture of FIG. 22.

As best illustrated in FIG. 7, the housing 106 may include a receiving area 118, and one or more components of the light fixture 102 may be at least partially received within the receiving area 118. In the embodiment of FIGS. 1-19, the mounting substrate 108, the reflector 110, the one or more light sources 114, and the electronics 116 are at least partially received within the receiving area 118 of the housing 106. As mentioned, the light fixture 102 is a linear light fixture in the embodiment of FIGS. 1-19 and a length of the housing 106 is greater than a width of the housing 106, although in other embodiments the housing 106 may have other shapes and/or sizes as desired. As one non-limiting example, FIGS. 22, 24, and 27 illustrate the housing 106 having a shorter length than that illustrated in FIGS. 1-19.

In certain embodiments, and as best illustrated in FIG. 7, the housing 106 includes one or more housing apertures 120. As discussed in detail below, an engagement component 122 of the mounting system 104 may be at least partially received in a corresponding housing aperture 120. The size, shape, number, and location of the apertures 120 should not be considered limiting. In other embodiments, other engagement or coupling features suitable for connecting with the engagement components 122 may be used in place of or in addition to the housing apertures 120.

Figure 5:
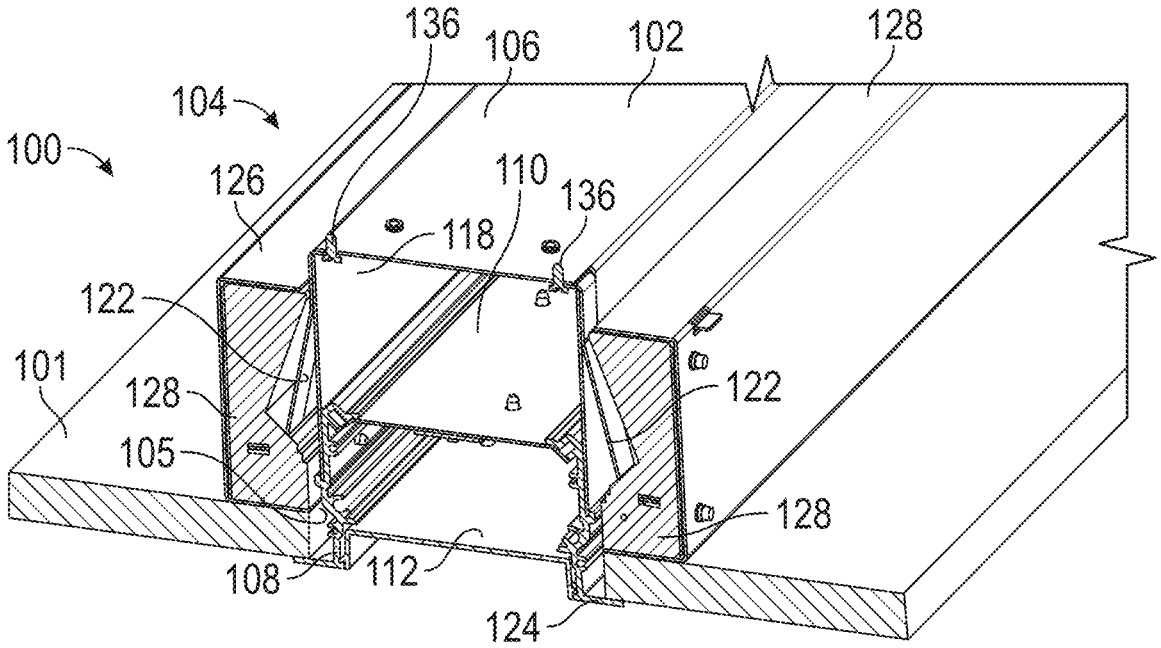
FIG. 5 is a perspective sectional view of the light fixture of FIG. 1.
Figure 6:
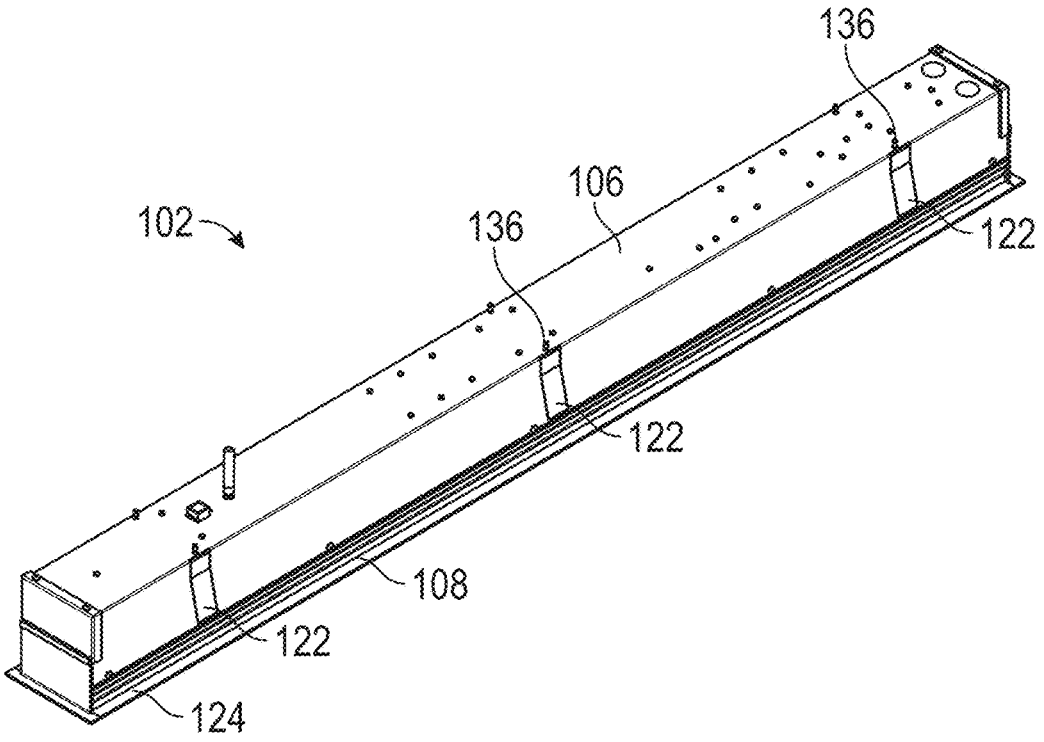
FIG. 6 is a perspective view of the light fixture of FIG. 1.

The mounting substrate 108 of the light fixture 102 may support the one or more light sources 114 of the light fixture 102. Optionally, and as best illustrated in FIG. 5, the mounting substrate 108 may support the reflector 110 of the light fixture 102 and/or the optic 112 of the light fixture 102. In some embodiments, the mounting substrate 108 may optionally include a flange 124. When included, the flange 124 may cover and/or at least partially contact a portion of a surface 103 of a structure 101 (e.g., a ceiling) that supports the light fixture 102. The flange 124 may optionally conceal gaps that might exist between the light fixture 102 and the edge of an aperture 105 in which the light fixture 102 is supported when installed.

The light sources 114 may be various types of light sources as desired. In some embodiments, the light sources 114 include light emitting diodes ("LEDs") mounted on a printed circuit board ("PCB") and wired to the PCB. Any number of LEDs and/or PCBs may be utilized. Each PCB may have wiring for connecting to a driver (see, e.g., electronics 116 in FIG. 27), which can be shared between PCBs or each PCB may have its own power supply. The LEDs may be single-die or multi-die LEDs, DC or AC, or can be organic light emitting diodes. White, color, or multicolor LEDs may be used. Moreover, the LEDs mounted on a PCB need not all be the same color; rather, mixtures of LEDs may be used. In other embodiments, light sources 114 other than LEDs may be utilized. The optic 112, when present, may be coupled to the housing 106 and/or the mounting substrate 108 so as to extend over the light sources 114 and control the appearance of light emitted from the light fixture 102.

The features of the light fixture 102 may be constructed from various suitable materials as desired, including but not limited to various metals and/or plastics. Various types of fasteners or other attachment mechanisms may be used to attach the various components of the light fixture 102. Fasteners or attachment mechanisms suitable for the light fixture 102 may include, but are not limited to, clips, screws, bolts, clasps, snap-fit connections, hooks, combinations thereof, or other devices or mechanisms as desired.

The mounting system 104 of the light fixture system 100 supports and secures the light fixture 102 to the structure 101 without requiring attachment to a building structure such as a joist. In various embodiments, the mounting system 104 includes one or more engagement components 122, one or more frames 126, and one or more holders 128. The number of engagement components 122, frames 126, and/or holders 128 should not be considered limiting on the disclosure. Optionally, the number of engagement components 122, frames 126, and/or holders 128 may depend on a length of the light fixture 102 to be supported by the mounting system 104. The features of the mounting system 104 may be constructed from various suitable materials as desired, including but not limited to various metals and/or plastics.

The engagement components 122 may be various devices or mechanisms that are connected to the light fixture 102 and can selectively engage the holders 128 of the mounting system 104 as discussed in detail below. In certain embodiments, the engagement components 122 may be flexible and/or compressible members that can be selectively compressed or biased as they engage the holders 128 during installation of the light fixture 102 and after installation of the light fixture 102. In some embodiments, the engagement components 122 may be biased towards engagement with the holders 128 of the mounting system 104.

Figure 4:
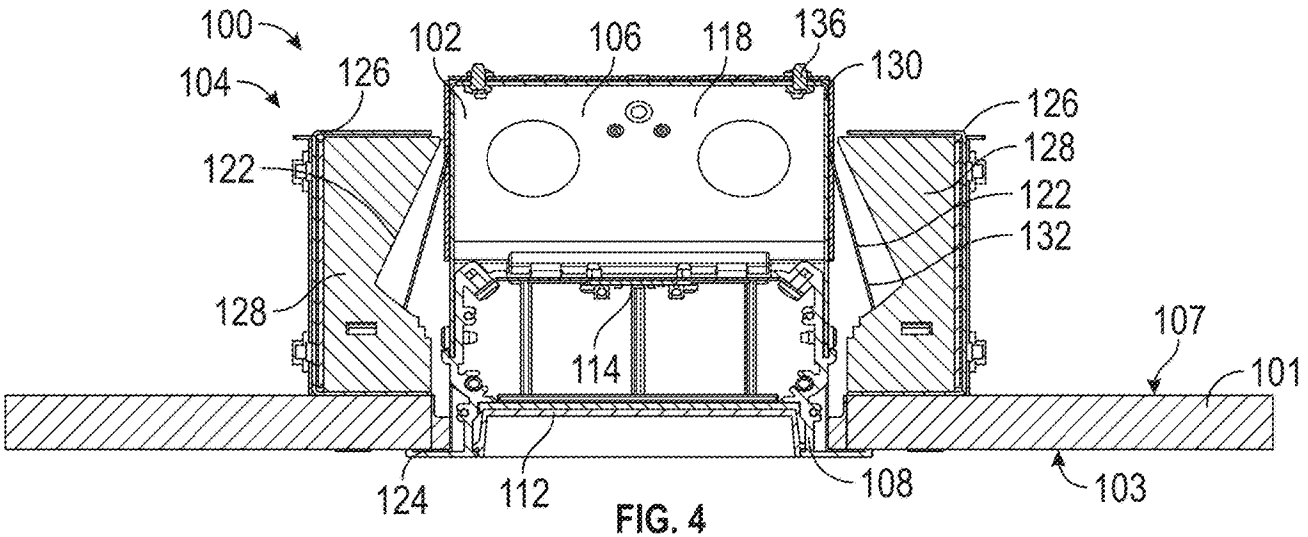
FIG. 4 is a sectional view of the light fixture of FIG. 1.

In the embodiment of FIGS. 1-19, the engagement components 122 are spring-type components having an upper flange 129, a first portion 130 extending downwardly from the upper flange 129, and a second portion 132 extending downwardly from the first portion 130. As discussed in detail below, the second portion 132 includes an end 134 that may selectively engage a corresponding holder 128 when the light fixture 102 is installed with the mounting system 104. In certain embodiments, the second portion 132 flares outwardly from the first portion 130 at a non-zero angle. In some embodiments, the angle $\alpha$ between the second portion 132 and the first portion 130 may be from greater than 0° to about 25°, although in other embodiments the angle $\alpha$ between the second portion 132 and the first portion 130 may be other angles as desired. The upper flange 129 may be partially inserted into one of the housing apertures 120 and may be connected to the housing 106 via fasteners 136 or other suitable mechanisms as desired such that the engagement component 122 is connected to the light fixture 102. As best illustrated in FIGS. 4 and 5, when the engagement components 122 are connected to the light fixture 102, the second portions 132 may extend outwards from the light fixture 102.

Figure 10:
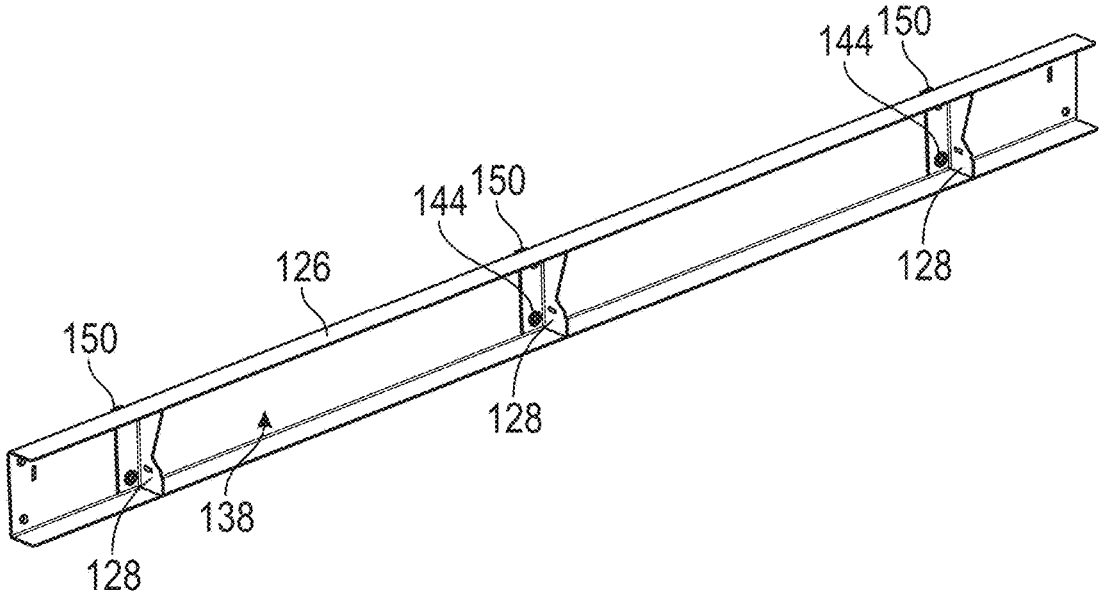
FIG. 10 is a perspective view of a portion of the mounting system of FIG. 1.
Figure 11:
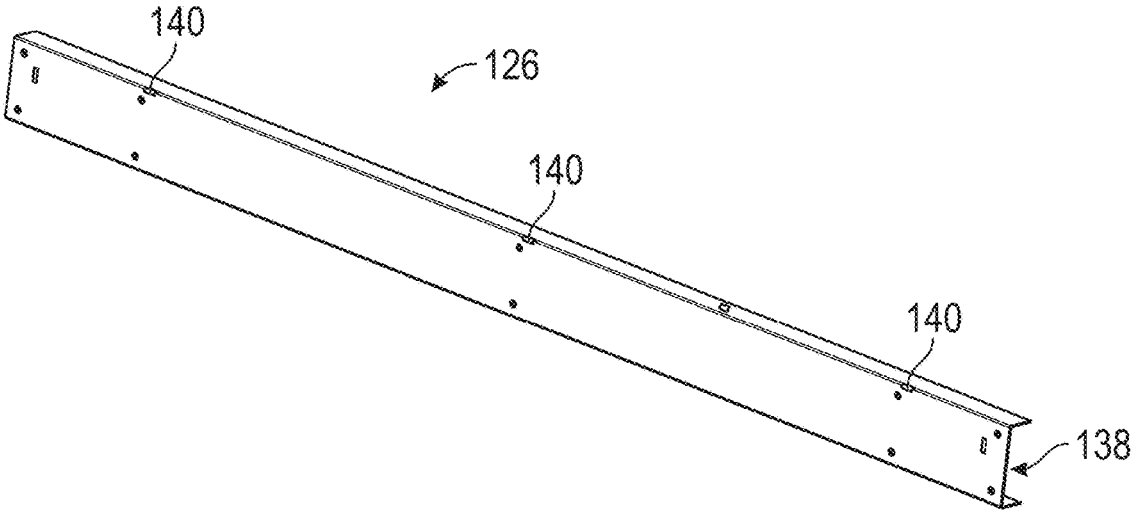
FIG. 11 is a perspective view of a frame of the mounting system of FIG. 1.

The frames 126 of the mounting system 104 may be elongated such that a length of each frame 126 is greater than a width of the frame 126. In certain embodiments, the width of each frame 126 is less than a width of the aperture 105 in the structure 101. As best illustrated in FIG. 10, each frame 126 supports at least one holder 128 (see FIGS. 12-14), and in certain embodiments, each frame 126 may support a plurality of holders 128. Optionally, and as illustrated in FIG. 10, the frame 126 defines a receiving area 138 that at least partially receives one or more holders 128. In other embodiments, and as illustrated in FIGS. 22-27, the frame 126 need not define a receiving area 138. Optionally, and as best illustrated in FIG. 11, each frame 126 may include one or more positioning apertures 140 that are configured to receive an positioning tab 150 from a corresponding holder 128. In various embodiments, the positioning apertures 140 and positioning tabs 150 may facilitate positioning and orienting of the holders 128 relative to the frames 126. In other embodiment, alignment features other than the positioning tabs 150 and positioning apertures 140 may be utilized as desired.

As best illustrated in FIGS. 1 and 5, the frames 126 may be secured on opposing sides of the aperture 105 and on an inner surface 107 that is opposite from the outer surface 103 of the structure 101. The frames 126 may be secured to the structure 101 via various devices or mechanisms as desired. In the embodiment of FIGS. 1-19, fasteners 142 such as screws secure the frames 126 to the structure 101. Optionally, end frames 145 may connect opposing frames 126.

Figure 13:
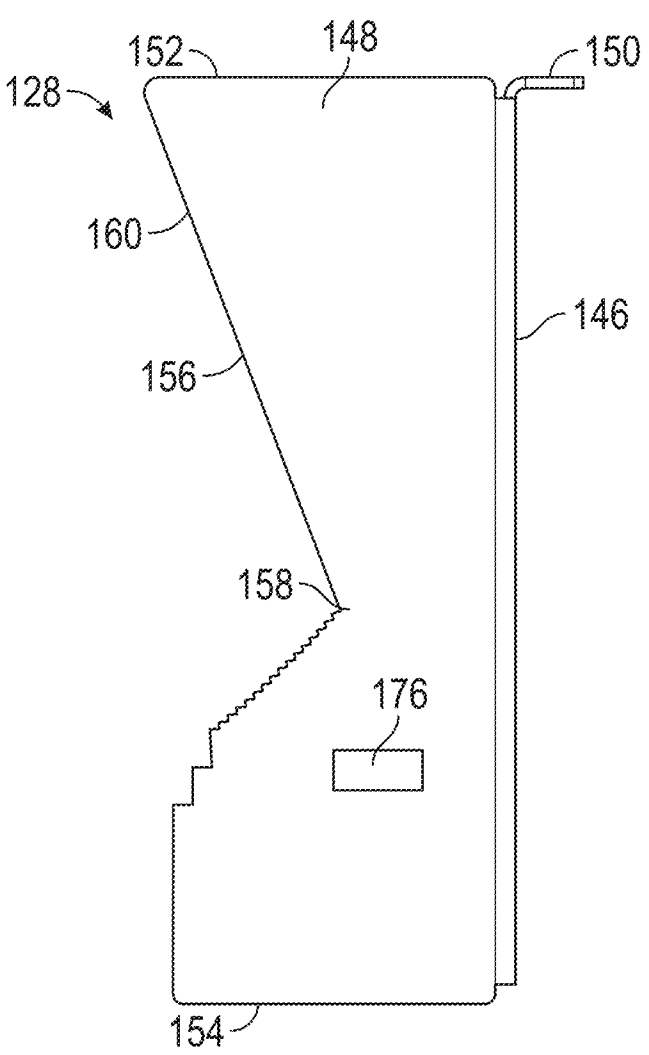
FIG. 13 is an end view of the holder of FIG. 12.
Figure 12:
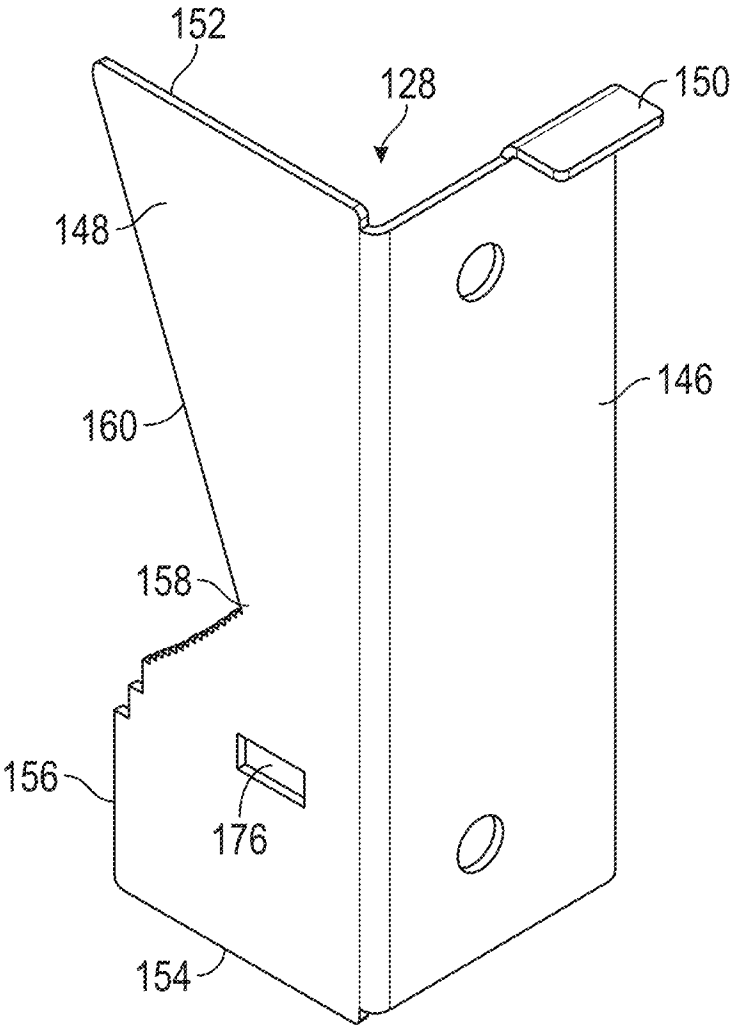
FIG. 12 is a perspective view of a holder of the mounting system of FIG. 1.

Each holder 128 may be connected to one of the frames 126 via various suitable mechanisms or devices as desired. In the embodiment of FIGS. 1-19, fasteners 144 such as screws or bolts connect each holder 128 to a corresponding frame 126. Referring to FIGS. 12-14, each holder 128 of the mounting system 104 includes a base 146 and a support portion 148 extending from the base 146. In certain embodiments, the base 146 optionally includes the positioning tab 150, which may extend from the base 146 in a direction opposite from the support portion 148. The positioning tab 150 is positionable within a corresponding positioning aperture 140 of the frame 126 to position and orient the holder 128 relative to the frame 126. In other embodiments, the positioning aperture 140 may be on the holder 128 and the positioning tab 150 may be on the frame 126, and/or other alignment features may be utilized as desired.

The support portion 148 includes a top end 152, a bottom end 154, and an edge 156 that extends from the top end 152 to the bottom end 154. As best illustrated in FIGS. 12 and 13, the edge 156 includes a transition portion 158 between the top end 152 and the bottom end 154. In various embodiments, the transition portion 158 is the portion of the edge 156 where the distance between the edge 156 and the base 146 is at a minimum. In some cases, the transition portion 158 is approximately halfway between the top end 152 and the bottom end 154, although it need not be in other embodiments. In the embodiment of FIGS. 1-19, the transition portion 158 is closer to the bottom end 154 than to the top end 152.

As best illustrated in FIGS. 12 and 13, the edge 156 includes an angled portion 160 between the transition portion 158 and the top end 152 that extends at an oblique angle relative to a vertical axis extending from the top end 152 to the bottom end 154. In certain embodiments, the angle of the angled portion 160 may be similar to the angle $\alpha$ between the first portion 130 and the second portion 132 of the engagement component 122, although it need not be in other embodiments. In some embodiments and as illustrated in FIGS. 12 and 13, the entire length of edge 156 between the transition portion 158 and the top end 152 may be the angled portion 160. In other embodiments, the angled portion 160 is less than the entire length of edge 156 between the transition portion 158 and the top end 152. In certain embodiments, when the light fixture 102 is installed using the mounting system 104, the angled portion 160 is adjacent to (and optionally contacts) the second portion 132 of the engagement component 122. In these embodiments, the angled portion 160 may minimize or prevent potential buckling of the second portion 132 of the engagement component 122.

In certain embodiments, the edge 156 above the transition portion 158 may define a maximum distance between the edge 156 and the base 146. In some embodiments, the distance between the edge 156 above the transition portion 158 and the base 146 may be greater than a distance between the edge 156 below the transition portion 158 and the base 146. In these embodiments, the edge 156 below the transition portion 158 may allow for the light fixture 102 to be easily installed from below, and the edge 156 above the transition portion 158 may help maintain the position of the light fixture 102 relative to the mounting system 104 and/or the structure 101. In other embodiments, the distance between the edge 156 above the transition portion 158 and the base 146 need not be greater than a distance between the edge 156 below the transition portion 158 and the base 146.

As best illustrated in FIGS. 13 and 14, the edge 156 below the transition portion 158 includes a first stepped portion 162 having at least one first step 166 and a second stepped portion 164 between the first stepped portion 162 and the transition portion 158 and having at least one second step 168. In various embodiments, at least one characteristic of the first step 166 is different from the second step 168. The at least one characteristic may include, but is not limited to, a number of steps, a height of the steps, a length of the steps, an angle of the steps relative to a horizontal axis, combinations thereof, and/or other characteristics as desired. The number, shape, and other characteristics of the steps illustrated in FIGS. 1-19 should not be considered limiting. In certain embodiments, the first stepped portion 162 may be adapted to temporarily support the light fixture 102 during installation, and the second stepped portion 164 may be adapted to support the light fixture 102 once installed.

Figure 14B:
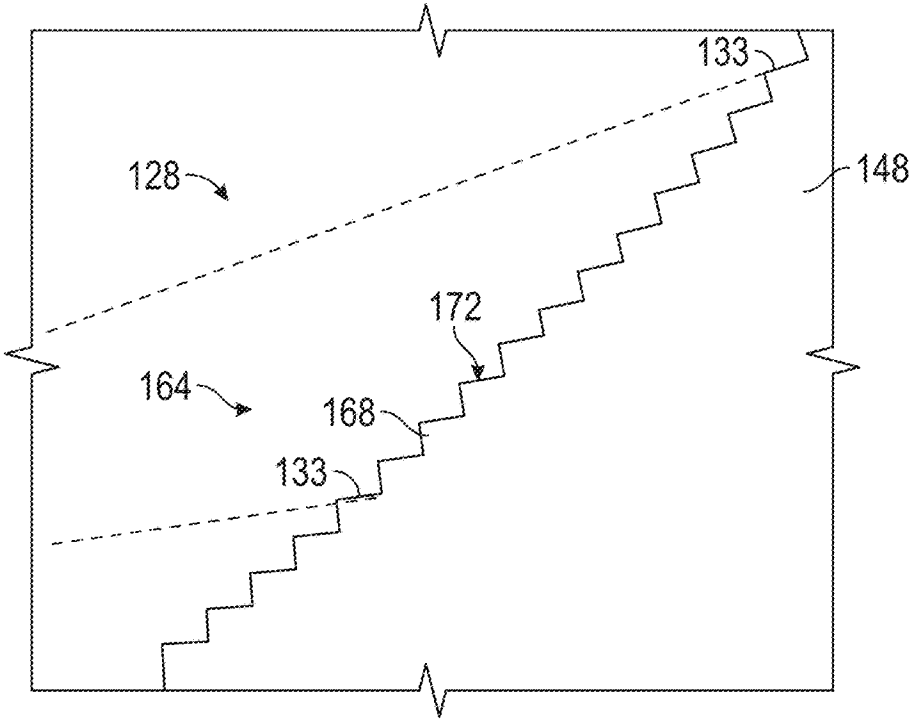
FIGS. 14A-C are end views of portions of the holder of FIG. 12.
Figure 14A:
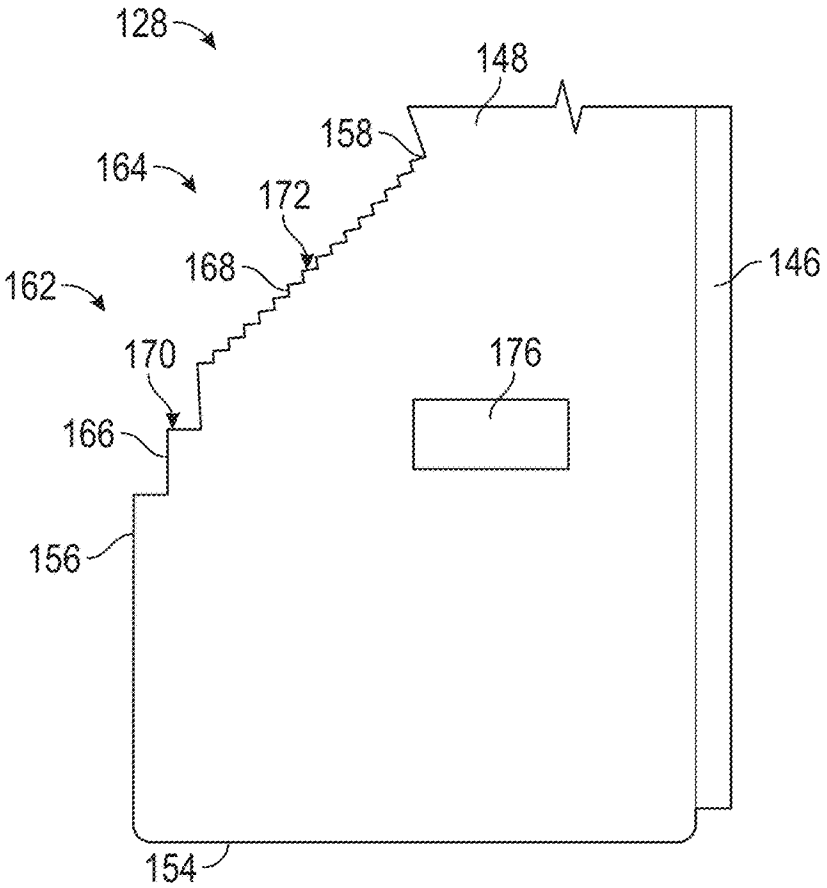
Figure 14C:
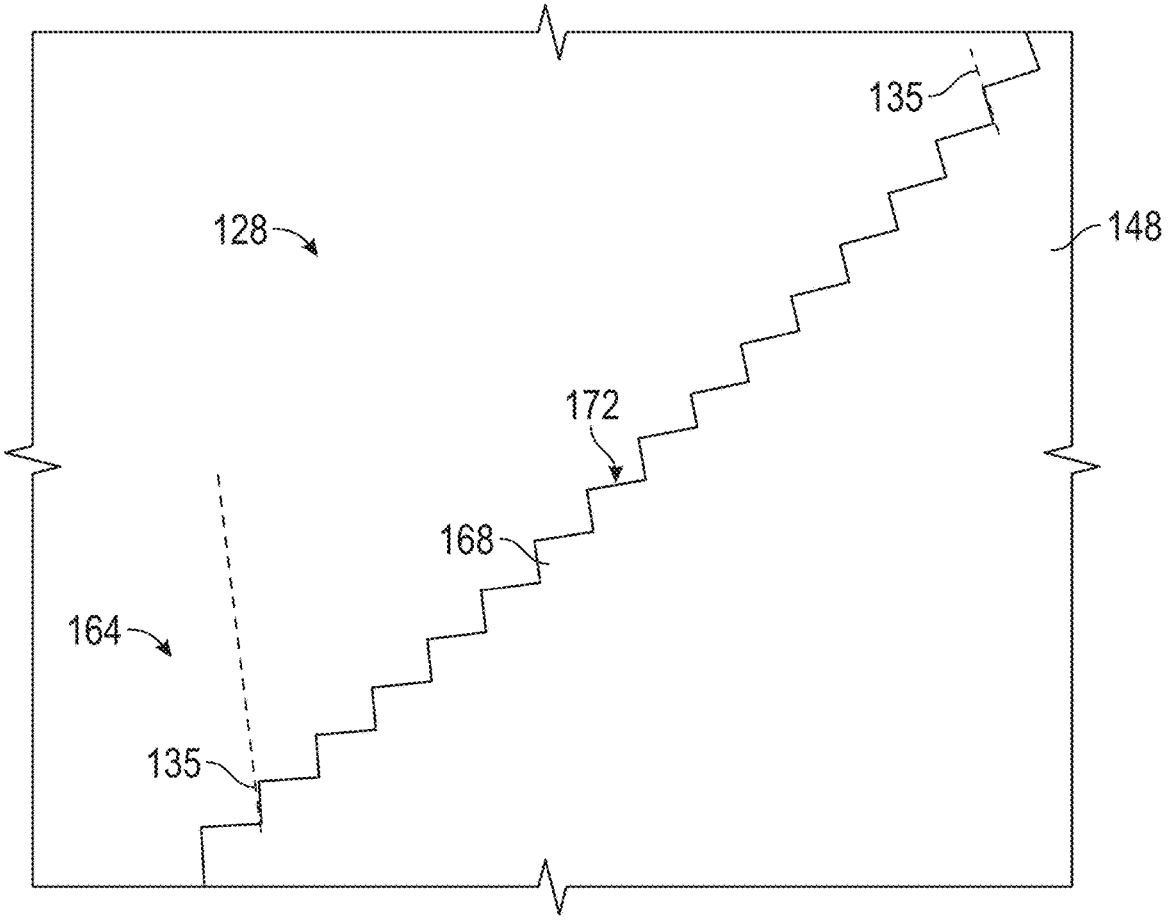
Figure 15:
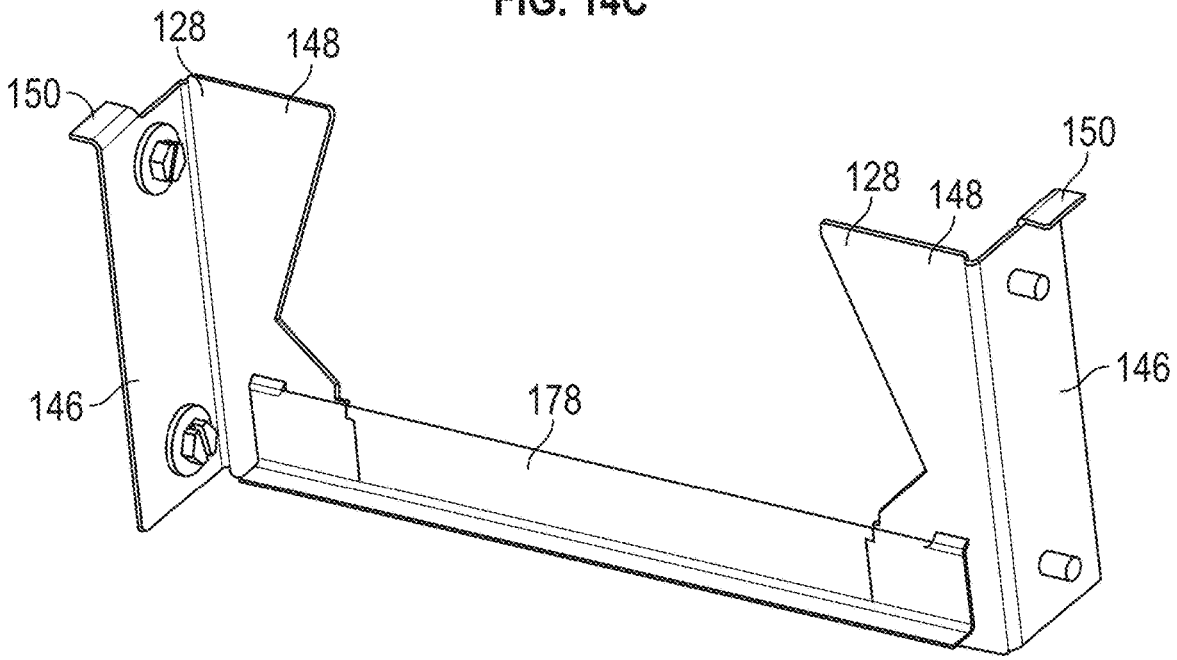
FIG. 15 is a perspective view of two mounting holders of the mounting system of FIG. 1 with a bridge according to embodiments.
Figure 16:
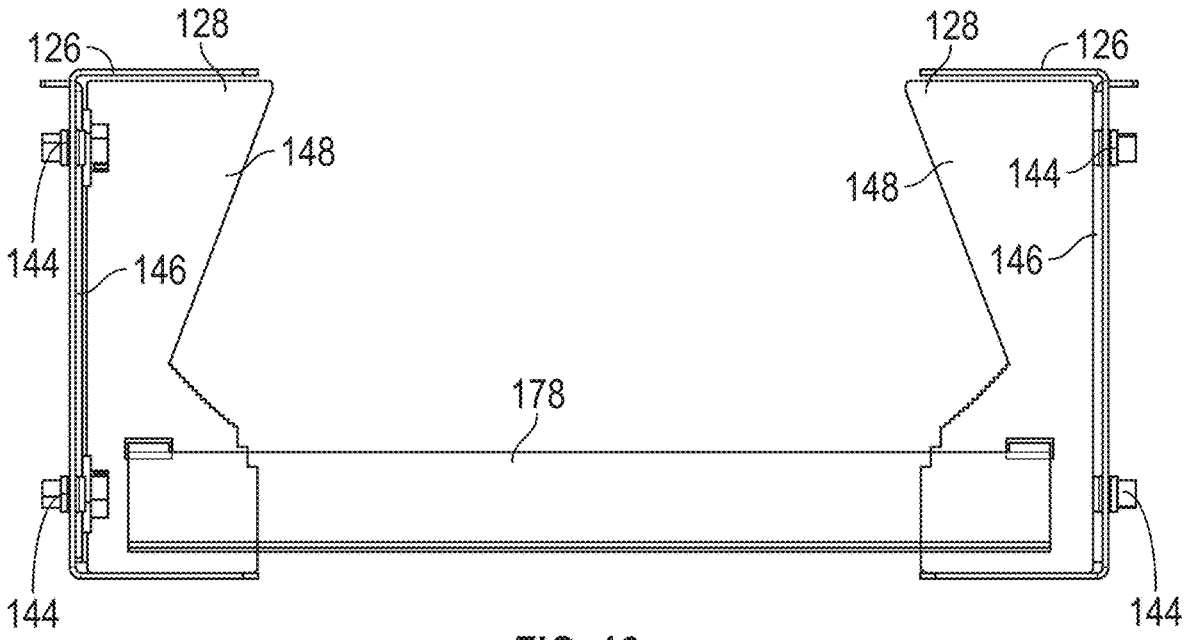
FIG. 16 is an end view of the mounting holders and bridge of FIG. 15.
Figure 17:
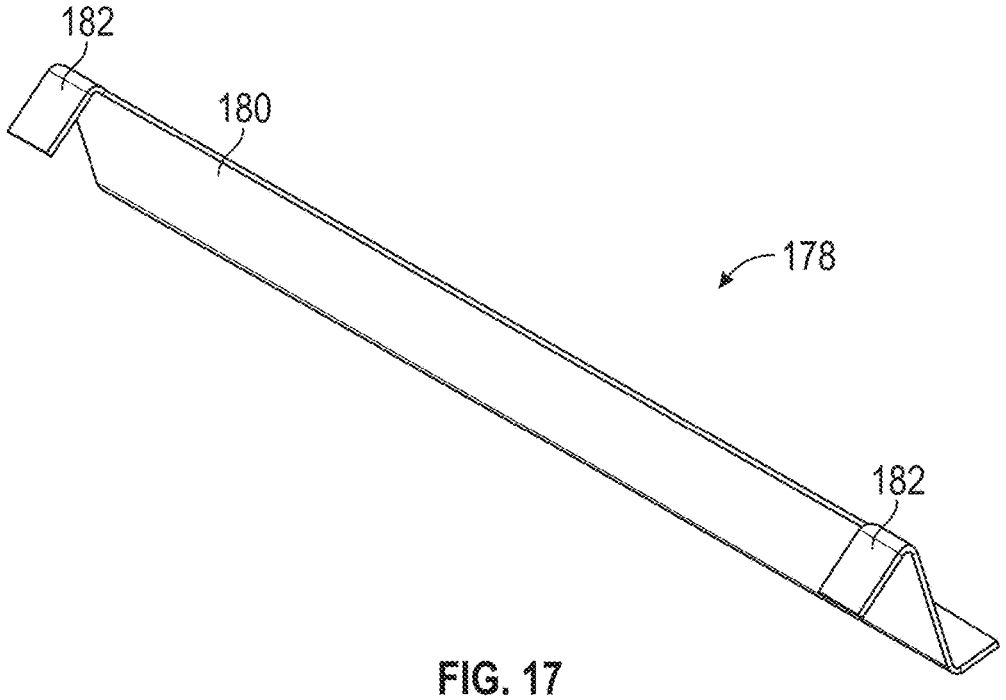
FIG. 17 is a perspective view of the bridge of FIG. 16.

In the embodiment illustrated in FIGS. 13 and 14A-C, the number of second steps 168 is greater than the number of first steps 166, a height of each first step 166 is greater than a height of each second step 168, and a length of each first step 166 is greater than a length of each second step 168. As illustrated in FIG. 14A, each first step 166 has a step surface 170 and each second step 168 has a step surface 172. In certain embodiments, the first steps 166 and the second steps 168 are provided along a curvature such that the step surfaces of adjacent steps are not parallel to each other and/or relative to a horizontal axis. In such embodiments, adjacent steps may be tilted by a tilt angle such that a rise (e.g., more vertically extending) portion of adjacent step surfaces are not parallel and/or such that a run (e.g., more horizontally extending) portion of adjacent step surfaces are not parallel. As some non-limiting examples, FIG. 14B illustrates how run portions 133 of steps 168 may not be parallel due to the tilt angle, and FIG. 14C illustrates how rise portions 135 of steps 168 may not be parallel due to the tilt angle. While the first steps 166 are not illustrated in FIGS. 14B-C, they may also be tilted by a tilt angle. In the embodiment of FIG. 14A-C, the step surfaces 170, 172 are progressively tilted downwards as the edge 156 gets closer to the transition portion 158. In some embodiments, the tilt angle may be from greater than 0° to about 2° relative to an adjacent step, such as from 1° to 2°, inclusive, although in other embodiments the tilt angle may be other angles as desired. Tilting adjacent steps may allow for the end 134 of the engagement component 122 to be seated in a corner of a particular step during installation and/or when installed, thereby providing a more secure engagement between the engagement component 122 and the holder 128.

In some embodiments, the support portion 148 of the holder 128 optionally includes a bridge aperture 176. During installation, holders 128 on opposing sides of the aperture 105 optionally may be connected by a bridge 178 that engages the bridge apertures 176. In the embodiment of FIGS. 1-19, the bridge 178 includes a body 180 with hooks 182 that engage the bridge apertures 176, although other types of bridges 178 may be utilized as desired. In embodiments with the bridge 178, the bridge 178 may minimize or prevent bowing or distortion of the mounting system while the frames 126 are being secured to the structure 101 and/or before the light fixture 102 is installed. In other embodiments, the bridge apertures 176 and/or the bridge 178 may be omitted.

Figure 18:
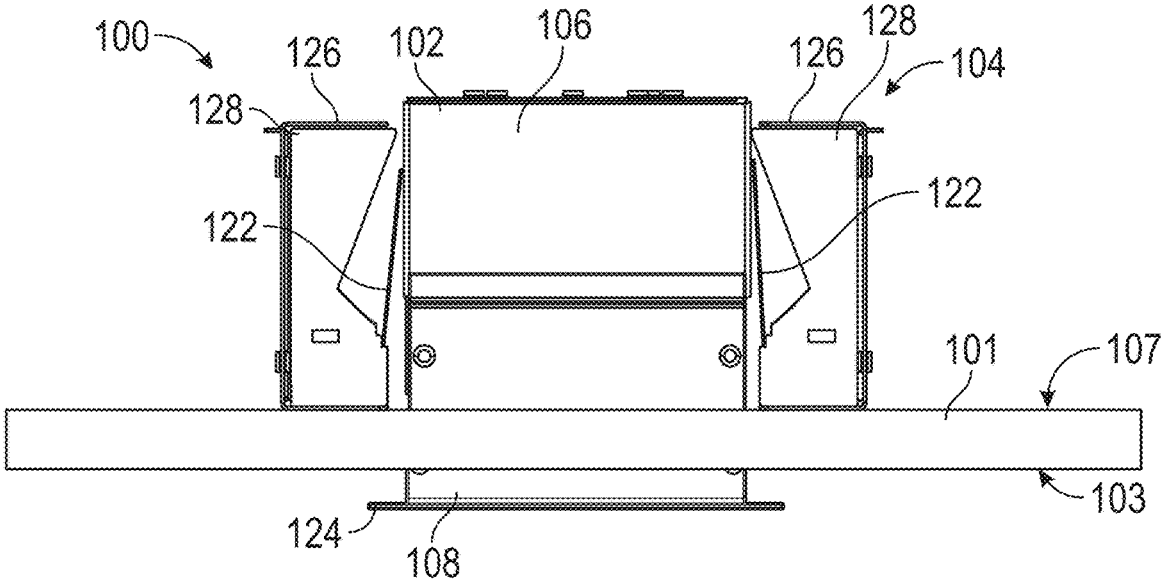
FIG. 18 is an end view of the light fixture of FIG. 1 in a first support position with the mounting system.
Figure 19:
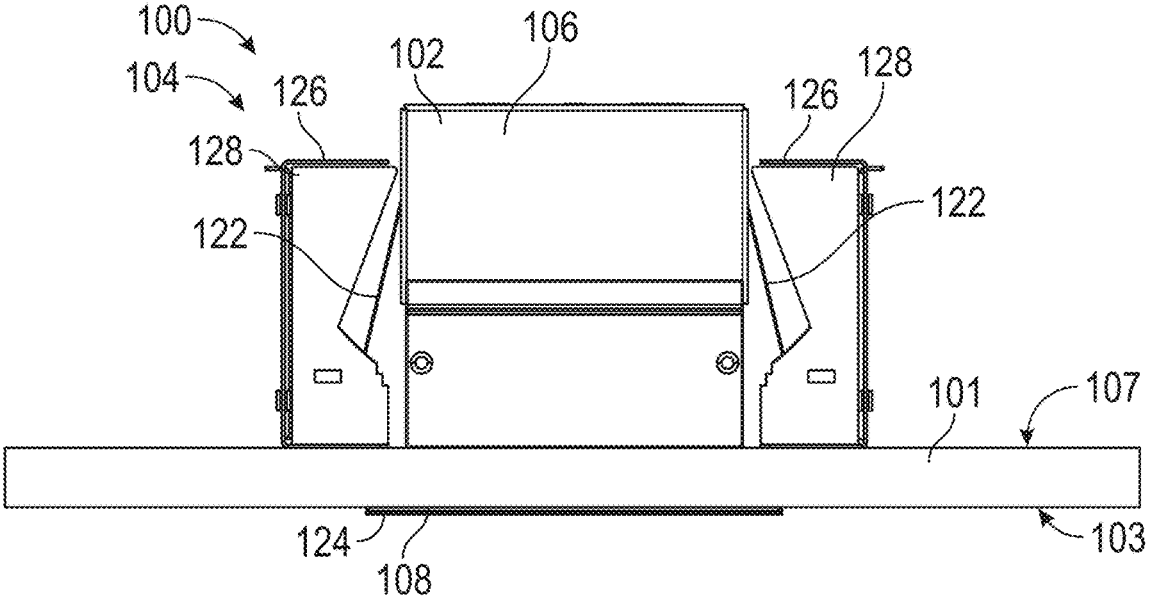
FIG. 19 is an end view of the light fixture of FIG. 1 in a second support position with the mounting system.

Referring to FIGS. 18 and 19, a method of installing the light fixture 102 using the mounting system 104 may include assembling the engagement components 122 with the light fixture 102, assembling the mounting system 104 relative to the structure 101, and installing the light fixture 102 using the mounting system 104.

In certain embodiments, assembling the engagement components 122 with the light fixture 102 may include inserting the upper flange 129 into the housing apertures 120 and securing the engagement components 122 to the housing 106.

In various embodiments, assembling the mounting system 104 relative to the structure 101 may include attaching the holders 128 to the frames 126, inserting the frames 126 through the aperture 105, and securing the frames 126 to the surface 107 of the structure 101. Optionally, assembling the mounting system 104 may include attaching opposing holders 128 together using the bridge 178. The bridge 178 may be disassembled prior to the installation of the light fixture 102.

Installing the light fixture 102 may include inserting the light fixture 102 through the aperture 105 to a first support position. Inserting the light fixture 102 through the aperture 105 may compress the engagement components 122. FIG. 18 illustrates the light fixture 102 in the first support position. In various embodiments, in the first support position, the ends 134 engage the first stepped portion 162 of the holder 128. In certain embodiments, in the first support position, a lower end of the light fixture 102, such as the flange 124, may be spaced apart from the outer surface 103 of the structure 101. In certain embodiments, the light fixture 102 optionally may be installed to the first support position to initially position the light fixture 102 relative to the structure 101 and while connections for the light fixture 102 are finished.

In some embodiments, installing the light fixture 102 includes moving the light fixture 102 from the first support position to a second support position where the engagement components 122 engage the second stepped portion 164 of the holder 128. FIG. 19 illustrates the light fixture in the second support position. Moving the light fixture 102 to the second support position may include further positioning of the light fixture 102 through the aperture 105. In certain embodiments, in the second support position, the flange 124 or lower end of the light fixture 102 may contact the surface 103 of the structure 101.

As such, the light fixture 102 may be installed from below the structure 101, and the light fixture 102 may be installed and supported on the structure 101 without requiring direct attachment to a building structure. Moreover, compared to traditional light fixtures, the light fixture 102 with the mounting system 104 may be positioned and self-supported in a plurality of support positions relative to the structure 101 depending on the particular steps engaged with the engagement components 122.

Figure 20:
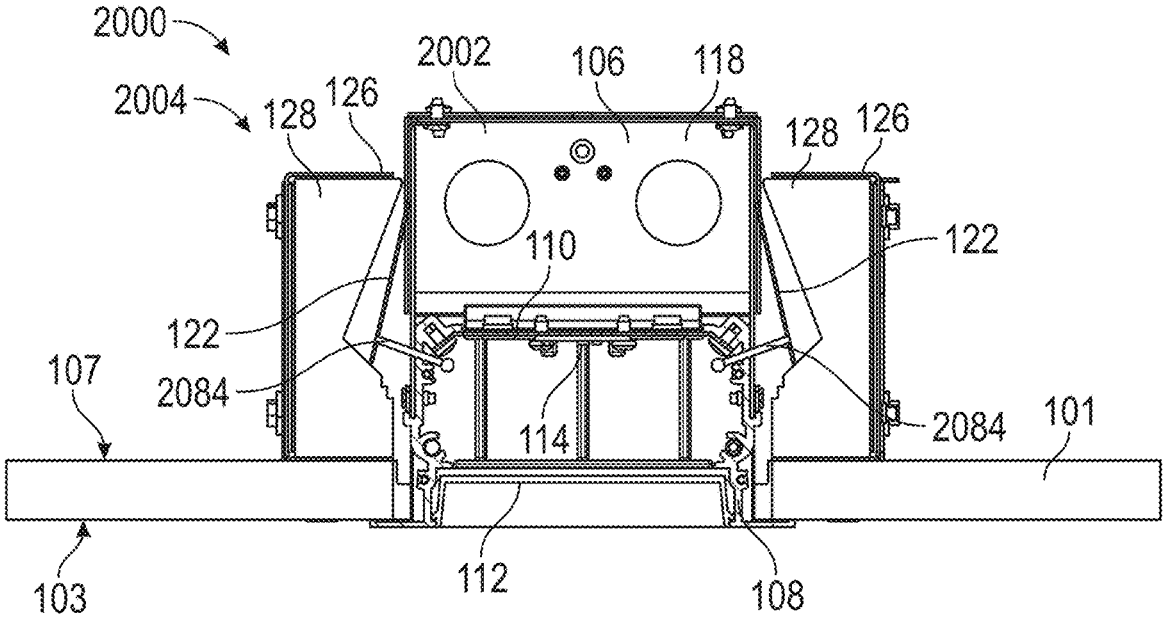
FIG. 20 is a sectional view of a light fixture with a mounting system according to embodiments.

FIG. 20 illustrates a light fixture system 2000 that is substantially similar to the light fixture system 100 and includes a light fixture 2002 and the mounting system 2004. The light fixture 2002 is substantially similar to the light fixture 102 and the mounting system 2004 is substantially similar to the mounting system 104 except that the housing 106 includes one or more apertures for receiving a disengaging component 2084 of the mounting system 2004. In the embodiment of FIG. 20, the disengaging component 2084 is a structure connected to the engaging component 122 that can be pulled inwards to disengage the engaging component 122 from the holder 128. Other types of disengaging components 2084 may be utilized as desired, and in some cases, the disengaging component 2084 need not extend through the housing 106.

Figure 21:
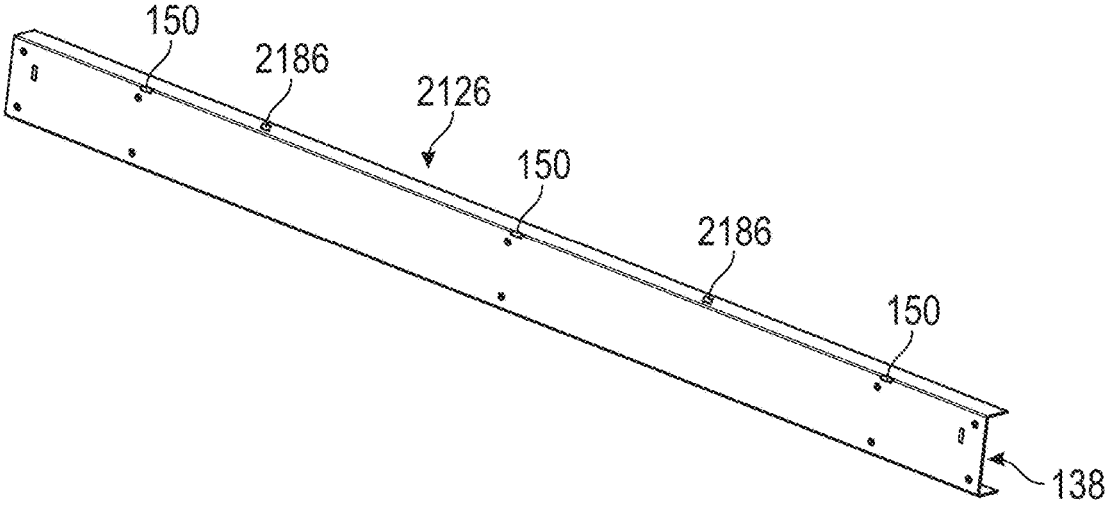
FIG. 21 is a perspective view of a frame for a mounting system according to embodiments.

FIG. 21 illustrates a frame 2126 that is substantially similar to the frame 126 except that the frame 2126 includes one or more tether apertures 2186. In this embodiment, a tether (not illustrated) may be connected to the frame 2126 and may be attached to a building structure such as a joist or other suitable structure as desired. In these embodiments, the tether attached to the frame 2126 may act as a safety mechanism that can suspend the light fixture in the event that the structure 101 fails.

FIGS. 22-27 illustrate an example of a light fixture system 2200 according to various embodiments. The light fixture system 2200 is substantially similar to the light fixture system 100 and includes the light fixture 102 and a mounting system 2204. The mounting system 2204 is substantially similar to the mounting system 104 except that the frames 2226 do not define the receiving area 138 and the holders 2228 are supported on an outer surface of the frames 2226. The holders 2228 are substantially similar to the holders 128 except that the angled portion 160 is not the entire edge 156 above the transition portion 158. Compared to the holders 128, the holders 2228 additionally include a lower positioning flange 2286 that overlaps an edge of the aperture 105 to further position and orient the mounting system 2204 relative to the structure 101. The engagement components 2222 are substantially similar to the engagement components 122 except that the end 134 includes extensions 2288. When installed, the engagement components 2222 are configured to engage the steps of the holders 2228 between the extensions 2288. The extensions 2288 may aid in positioning the holders 2228 relative to the engagement components 2222 and may optionally act as stoppers to minimize or prevent side-to-side movement of the holders 2228 on the engagement components 2222. In other words, the extensions 2288 may minimize or prevent the holders 2228 from sliding off and/or otherwise become disengaged from the engagement components 2222.

A collection of exemplary embodiments are provided below, including at least some explicitly enumerated as "Illustrations" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration 1. A mounting system for a recessed light fixture, wherein the mounting system comprises: a frame; and a holder supported by the frame, wherein the holder comprises a base and a support portion extending from the base, wherein the support portion comprises: a top end; a bottom end opposite from the top end; and an edge extending from the top end to the bottom end, wherein the edge comprises: a transition portion between the top end and the bottom end, wherein a distance from the transition portion to the base a minimum distance between the edge and the base; a first step between the bottom end and the transition portion; and a plurality of second steps between the first step and the transition portion, wherein at least one characteristic of the first step is different from each second step.

Illustration 2. The mounting system of any preceding or subsequent illustrations or combination of illustrations, wherein the at least one characteristic comprises a height of the first step, and wherein the height of the first step is greater than a height of each second step.

Illustration 3. The mounting system of any preceding or subsequent illustrations or combination of illustrations, wherein the at least one characteristic comprises a length of the first step, and wherein a length of the first step is greater than a length of each second step.

Illustration 4. The mounting system of any preceding or subsequent illustrations or combination of illustrations, wherein the at least one characteristic comprises an orientation relative to a lateral axis of the holder, and wherein the first step is not parallel to at least one of the lateral axis or one second step of the plurality of second steps.

Illustration 5. The mounting system of any preceding or subsequent illustrations or combination of illustrations, wherein the frame defines a receiving area, and wherein the holder is at least partially positioned within the receiving area of the frame.

Illustration 6. The mounting system of any preceding or subsequent illustrations or combination of illustrations, wherein the frame comprises a positioning aperture, wherein the holder comprises a positioning tab extending from the base, and wherein the positioning tab is receivable within the positioning aperture of the frame.

Illustration 7. The mounting system of any preceding or subsequent illustrations or combination of illustrations, wherein the plurality of second steps are provided along a curvature such that adjacent second steps are tilted by a tilt angle that is greater than 0°.

Illustration 8. A holder for a mounting system for a recessed light fixture, the holder comprising: a base; and a support portion extending from the base and comprising a plurality of first steps and a plurality of second steps opposite from the base, wherein a height of each first step is different from a height of each second step.

Illustration 9. The holder of any preceding or subsequent illustrations or combination of illustrations, wherein a length of each first step is different from a length of each second step.

Illustration 10. The holder of any preceding or subsequent illustrations or combination of illustrations, wherein the plurality of second steps are provided along a curvature such that adjacent second steps are tilted by a tilt angle that is greater than 0°.

Illustration 11. The holder of any preceding or subsequent illustrations or combination of illustrations, wherein the tilt angle between adjacent steps is from is from 1° to 2°, inclusive.

Illustration 12. The holder of any preceding or subsequent illustrations or combination of illustrations, wherein the support portion further comprises a bridge aperture, wherein the bridge aperture is configured to engage a bridge connected to another holder.

Illustration 13. The holder of any preceding or subsequent illustrations or combination of illustrations, further comprising a positioning tab extending from the base opposite from the support portion, wherein the positioning tab is configured to engage a frame of the mounting system.

Illustration 14. The holder of any preceding or subsequent illustrations or combination of illustrations, wherein the support portion comprises a top end, a bottom end, and an edge opposite from the base extending from the top end to the bottom end, wherein the edge comprises a transition portion between the top end and the bottom end, wherein the transition portion comprises a minimum distance between the edge and the base, and wherein the edge between the transition portion and the bottom end defines the plurality of first steps and the plurality of second steps.

Illustration 15. The holder of any preceding or subsequent illustrations or combination of illustrations, wherein the edge between the transition portion and the top end comprises a maximum distance between the edge and the base.

Illustration 16. A light fixture system comprising a mounting system, the mounting system comprising: an engagement component for a light fixture of the light fixture system, wherein the engagement component comprises an end and is compressible; and a holder comprising a base and a support portion extending from the base, wherein the support portion comprises an edge opposite from the base, and wherein the edge comprises a first step and a second step opposite from the base, wherein a height of the first step is different from a height of the second step, and wherein the end of the engagement component is configured to selectively engage at least one of the first step or the second step.

Illustration 17. The light fixture system of any preceding or subsequent illustrations or combination of illustrations, further comprising the light fixture, wherein the light fixture comprises a housing, wherein the housing comprises at least one receiving aperture, and wherein a portion of the engagement component extends through the at least one receiving aperture of the housing.

Illustration 18. The light fixture system of any preceding or subsequent illustrations or combination of illustrations, wherein the end of the engagement component comprises a first extension and a second extension opposite from the first extension, and wherein the engagement component is configured to engage the holder such that the end of the engagement component engages the first step or the second step between the first extension and the second extension.

Illustration 19. The light fixture system of any preceding or subsequent illustrations or combination of illustrations, wherein the holder comprises a plurality of first steps and a plurality of second steps.

Illustration 20. The light fixture system of any preceding or subsequent illustrations or combination of illustrations, wherein the plurality of second steps are provided along a curvature such that adjacent second steps are tilted by a tilt angle.

Illustration 21. A method of mounting a recessed light fixture with a mounting system, the method comprising: inserting the mounting system through an aperture in a ceiling, wherein the mounting system comprises a frame and a holder supported by the frame; securing the frame of the mounting system to an upper surface of the ceiling; inserting a light fixture into the aperture in the ceiling and vertically moving the light fixture to a first position such that an engagement component on the light fixture is compressed and the engagement component engages a first step of the holder of the mounting system; and moving the light fixture vertically to a second position such that the engagement component disengages the first step and engages a second step of the holder of the mounting system, wherein a height of the first step is greater than a height of the second step.

Illustration 22. The method of claim 21, wherein, in the first position, a gap is defined between a lower surface of the ceiling and a lower end of the light fixture, and wherein, in the second position, the lower end of the light fixture contacts the lower surface of the ceiling.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others are intended to refer to the orientation as illustrated and described in the figure (or figures) to which the components and directions are referencing but are not intended to imply any particular configuration.

The above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed is:

1. A mounting system for a recessed light fixture, wherein the mounting system comprises:
- a frame; and
- a holder supported by the frame, wherein the holder comprises a base and a support portion extending from the base, wherein the support portion comprises:
  - a top end;
  - a bottom end opposite from the top end; and
  - an edge extending between the top end and the bottom end, wherein the edge comprises:
    - a transition portion between the top end and the bottom end, wherein a distance from the transition portion to the base defines a minimum distance between the edge and the base;
    - a first step between the bottom end and the transition portion; and
    - a plurality of second steps between the first step and the transition portion, wherein at least one characteristic of the first step is different from each second step.

2. The mounting system of claim 1, wherein the at least one characteristic comprises a height of the first step, and wherein the height of the first step is greater than a height of each second step.

3. The mounting system of claim 1, wherein the at least one characteristic comprises a length of the first step, and wherein a length of the first step is greater than a length of each second step.

4. The mounting system of claim 1, wherein the at least one characteristic comprises an orientation relative to a lateral axis of the holder, and wherein the a surface of the first step is not parallel to at least one of the lateral axis or a surface of one second step of the plurality of second steps.

5. The mounting system of claim 1, wherein the frame defines a receiving area, and wherein the holder is at least partially positioned within the receiving area of the frame.

6. The mounting system of claim 1, wherein the frame comprises a positioning aperture, wherein the holder comprises a positioning tab extending from the base, and wherein the positioning aperture is adapted to receive the positioning tab.

7. The mounting system of claim 1, wherein the plurality of second steps are provided along a curvature such that adjacent second steps are tilted by a tilt angle that is greater than 0°.

8. A holder for a mounting system for a recessed light fixture, the holder comprising:

a base; and a support portion extending from the base and comprising a plurality of first steps and a plurality of second steps distal from the base, wherein a height of each first step is different from a height of each second step.

9. The holder of claim 8, wherein a length of a surface of each first step is different from a length of a surface of each second step.

10. The holder of claim 8, wherein the plurality of second steps are provided along a curvature such that adjacent second steps are tilted by a tilt angle that is greater than 0°.

11. The holder of claim 10, wherein the tilt angle between adjacent steps is from is from 1° to 2°, inclusive.

12. The holder of claim 8, wherein the support portion further comprises a bridge aperture, wherein the bridge aperture is configured to engage a bridge connected to another holder.

13. The holder of claim 8, further comprising a positioning tab extending from the base in a direction opposite from the support portion, wherein the positioning tab is configured to engage a frame of the mounting system.

14. The holder of claim 8, wherein the support portion comprises a top end, a bottom end, and an edge distal from the base and extending from the top end to the bottom end, wherein the edge comprises a transition portion between the top end and the bottom end, wherein the transition portion defines a minimum distance between the edge and the base, and wherein the edge between the transition portion and the bottom end defines the plurality of first steps and the plurality of second steps.

15. The holder of claim 14, wherein the edge between the transition portion and the top end defines a maximum distance between the edge and the base.

16. A light fixture system comprising a mounting system, the mounting system comprising:

an engagement component for a light fixture of the light fixture system, wherein the engagement component comprises an end and is compressible; and a holder comprising a base and a support portion extending from the base, wherein the support portion comprises an edge distal from the base, and wherein the edge defines a first step and a second step, wherein a height of the first step is different from a height of the second step, and wherein the end of the engagement component is configured to selectively engage at least one of the first step or the second step.

17. The light fixture system of claim 16, further comprising the light fixture, wherein the light fixture comprises a housing, wherein the housing comprises at least one receiving aperture, and wherein a portion of the engagement component extends through the at least one receiving aperture of the housing.

18. The light fixture system of claim 16, wherein the end of the engagement component comprises a first extension and a second extension opposite from the first extension, and wherein the engagement component is configured to engage the holder such that the end of the engagement component engages the first step or the second step between the first extension and the second extension.

19. The light fixture system of claim 16, wherein the holder comprises a plurality of first steps and a plurality of second steps.

20. The light fixture system of claim 19, wherein the plurality of second steps are provided along a curvature such that adjacent second steps are tilted by a tilt angle.

* * * * *